US012318010B2

(12) United States Patent
De La Haye

(10) Patent No.: US 12,318,010 B2
(45) Date of Patent: Jun. 3, 2025

(54) BODY SUPPORT ASSEMBLY

(71) Applicant: UBED B.V., Oudeschild (NL)

(72) Inventor: Cornelis Franciscus De La Haye, Oudeschild (NL)

(73) Assignee: UBED B.V., Oudeschild (NL)

( * ) Notice: Subject to any disclaimer, the term of this patent is extended or adjusted under 35 U.S.C. 154(b) by 404 days.

(21) Appl. No.: 17/762,592

(22) PCT Filed: Sep. 25, 2020

(86) PCT No.: PCT/NL2020/050600
§ 371 (c)(1),
(2) Date: Mar. 22, 2022

(87) PCT Pub. No.: WO2021/060987
PCT Pub. Date: Apr. 1, 2021

(65) Prior Publication Data

US 2022/0395104 A1 Dec. 15, 2022

(30) Foreign Application Priority Data

Sep. 27, 2019 (NL) ..... 2023913
Mar. 23, 2020 (NL) ..... 2025187

(51) Int. Cl.
*A47C 21/04* (2006.01)
*A47C 23/043* (2006.01)
(Continued)

(52) U.S. Cl.
CPC ..... *A47C 21/044* (2013.01); *A47C 21/048* (2013.01); *A47C 23/043* (2013.01); *A47C 27/121* (2013.01); *A47C 31/006* (2013.01)

(58) Field of Classification Search
CPC ..... A47C 21/00; A47C 21/04; A47C 21/042; A47C 21/044; A47C 21/048;
(Continued)

(56) References Cited

U.S. PATENT DOCUMENTS 1,142,876 A * 6/1915 Davis et al. ..... A47C 21/048 5/284
3,266,064 A * 8/1966 Figman ..... A47C 21/044 5/641
(Continued)

FOREIGN PATENT DOCUMENTS

EP 2848721 B1 1/2018
EP 3064627 B1 8/2018
(Continued)

OTHER PUBLICATIONS

International Search Report for Application No. PCT/NL2020/050600; mailing date: Dec. 15, 2020.
(Continued)

*Primary Examiner* — Fredrick C Conley
(74) *Attorney, Agent, or Firm* — N.V. Nederlandsch Octrooibureau

(57) ABSTRACT

Body support assembly (1) having a top surface (2) and a spaced away bottom surface (3) defining a cushion volume (4) and defining side walls (5). The air permeability of the top surface (2) is higher than the air permeability of the bottom surface (3). The cushion volume (4) comprises an upper cushion zone (7) and a lower cushion zone (8) and separated by a separation sheet (9). The upper cushion zone (7) and the lower cushion zone (8) comprise of a compressible material (10) which is permeable for air in all directions. The cushion volume (4) further comprises a flow path for air comprising an air inlet (6) in the bottom surface (3), air displacement means (20), a heat exchanger (21), a flow path through the compressible material of the lower cushion zone (8), through openings in the separation sheet (9) and through the compressible material (10) of the upper cushion zone (7) and multiple air outlets as present in the top surface (2).

19 Claims, 6 Drawing Sheets

Figure 1:
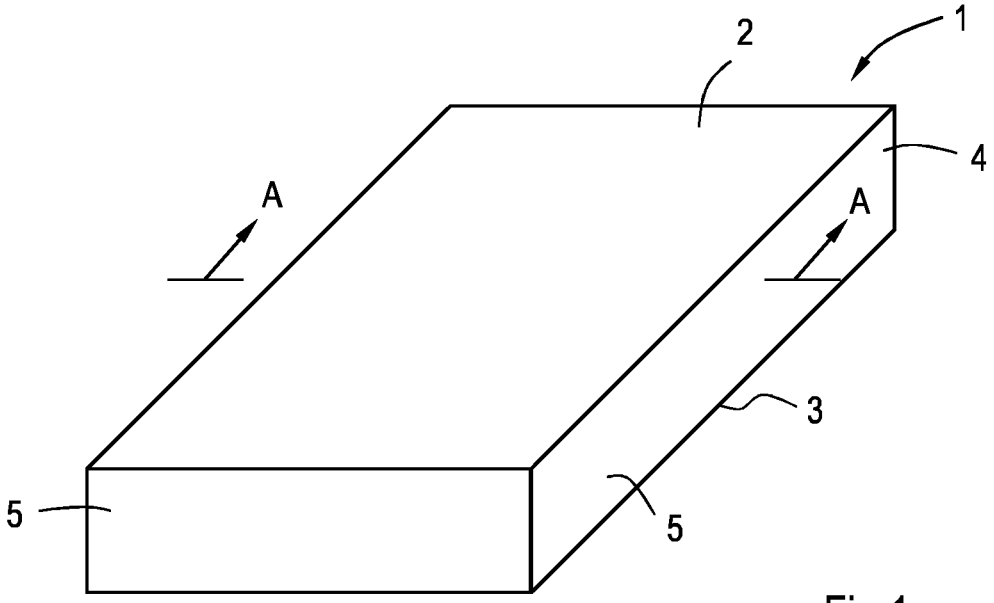

(51) Int. Cl.
*A47C 27/12* (2006.01)
*A47C 31/00* (2006.01)

(58) Field of Classification Search
CPC ... A47C 23/043; A47C 27/121; A47C 31/006; A47C 27/122; A47C 17/00; A47C 17/86; A47C 27/04
See application file for complete search history.

(56) References Cited

U.S. PATENT DOCUMENTS

| | | | | |
|---|---|---|---|---|
| 11,202,514 | B1 * | 12/2021 | Blakely | A47C 27/05 |
| 2006/0080778 | A1 * | 4/2006 | Chambers | A47C 21/044 5/652.2 |
| 2010/0011502 | A1 * | 1/2010 | Brykalski | A47C 21/044 5/423 |
| 2010/0229302 | A1 * | 9/2010 | De Bock | A47C 31/006 5/248 |
| 2011/0289684 | A1 * | 12/2011 | Parish | A47C 21/044 5/421 |
| 2016/0174725 | A1 * | 6/2016 | Takaoka | A47C 27/006 5/652.1 |
| 2017/0079444 | A1 * | 3/2017 | Blazar | A47C 27/14 |
| 2017/0325595 | A1 | 11/2017 | DeFranks et al. | |

FOREIGN PATENT DOCUMENTS

| | | | |
|---|---|---|---|
| KR | 20060124553 | A | 12/2006 |
| WO | 2014204934 | A1 | 12/2014 |
| WO | 2015106258 | A1 | 7/2015 |
| WO | 2015140259 | A1 | 9/2015 |
| WO | 2018022760 | A1 | 2/2018 |
| WO | 2018187348 | A1 | 10/2018 |
| WO | 2019165074 | A1 | 8/2019 |

OTHER PUBLICATIONS

Search Report and Written Opinion for Application No. NL 2023913.

* cited by examiner

BODY SUPPORT ASSEMBLY

CROSS-REFERENCE TO RELATED APPLICATIONS

This application is a 35 U.S.C. § 371 National Phase Entry Application of International Application No. PCT/NL2020/050600 filed Sep. 25, 2020, which claims benefit under 35 U.S.C. § 119(a) of NL Application No. 2023913 filed Sep. 27, 2019 and NL Application No. 2025187 filed Mar. 23, 2020, the contents of which are incorporated herein by reference in their entireties.

The invention is directed to a body support assembly having a top surface for supporting a body and a spaced away bottom surface defining a cushion volume and defining side walls, wherein the cushion volume comprises a heating element.

US2017/0325595 describes a mattress having foam layers and a coil spring layer provided with upwardly directed channels for directing a flow of conditioned air towards the sleeps surface.

WO2015106258 describes a mattress and bed combination wherein the bed is provided with fans to draw air from the top surface through the mattress downwardly to a lower positioned air conditioning layer. The conditioned air is discharged to the surroundings of the mattress—bed combination with the object to influence the temperature adjacent to the sleep surface.

WO2018022760 describes a mattress to support a body wherein within the mattress resistive heating elements are positioned. Such resistive heating elements may be a resistive heating coil as present between two layers in a looping or serpentine arrangement. The cooling is by a separate mechanism wherein air is pulled and the associated heat and moisture from the contact area supporting a body via one or more channels equipped with a fan.

WO2014204934 describes a mattress provided with numerous Peltier effect heating and cooling elements which are positioned near the top surface of the mattress in a continuous layer of a flexible foam. The top side of the elements either directly heat or cool the top side of the mattress while the opposite side of the Peltier effect elements are heated or cooled at their lower side by a flow of air being drawn through the mattress. A disadvantage of such a mattress is that the Peltier effect elements have to be positioned relatively near the surface in order to directly heat or cool the surface which supports the body. This may result in a less comfortable mattress as the body may feel the single Peltier effect elements.

KR20060124553 describes a body support assembly with an upper zone and a lower zone. The upper zone is provided with a compressible material. The lower zone is provided with metal springs. An air heater is partly outside the support assembly and can provide warm air to the body support assembly to heat up the upper side of the assembly. The person being supported by the support assembly will feel the warmth when laying on the support sheet of the support assembly. This because hot air flowing along the lower side of the non-air permeable support sheet will heat up this support sheet.

The body support described in either WO2018022760 or WO2014204934 is advantageous in that the heating element is positioned within the cushion volume. This avoids that separate heating elements have to be connected to the body support assembly apart from a power supply and a control system to regulate the heating and cooling.

WO2019165074 discloses a mattress comprising a body supporting layer comprising defined upward channels, and a pocketed coil base layer adjacent thereto, and a fan operably connected through a conduit to an inlet hole in the base layer, the fan for providing air flow into the inlet hole of the base layer. The fan provides heated and/or cooled upwardly directed air flow to the based layer, and through the base-layer and through the channels in the body supporting layer. A disadvantage of this support member is that directed air flows are created in the top layer, resulting in perceptible air movement, and hence discomfort due to draft. Also, the air flow requires sufficient velocity due to the pressure drop over the channels in the top layer. The present invention aims to provide a body support assembly wherein a heating unit is positioned within the cushion volume and which does not have the disadvantage of the known matrass in terms of comfort.

This is achieved by the following body support assembly: a body support assembly having a top surface for supporting a human body and a spaced away bottom surface defining a cushion volume and defining side walls, wherein the air permeability of the top surface is higher than the air permeability of the bottom surface and higher than the air permeability of the side walls, wherein the cushion volume comprises, an upper cushion zone nearest to the top surface and a lower cushion zone and separated by a separation sheet, wherein the upper cushion zone and the lower cushion zone comprise of a compressible material which is permeable for air in all directions and a flow path for air comprising an air inlet in the bottom surface, air displacement means, a heat exchanger, a flow path through the compressible material of the lower cushion zone, through openings in the separation sheet and through the compressible material of the upper cushion zone and multiple air outlets as present in the top surface.

Applicants found that such a body support assembly provides a comfortable sleeping experience in moderate climate environments. This may be explained by the fact that a small flow of heated air flows through the top surface and past the user of the body support assembly. It has been found that when the temperature of the air flowing through the upper cushion zone is just below that of the body temperature of the user a comfortable sleep experience is achieved. It has also been found that the volume of air required to achieve this effect may be low. This results in that the capacity of the air displacement means may be low and therefore the resulting noise may be low to non-detectable for the user. A further advantage is the larger components of the body support assembly such as the air displacement means and heat exchanger are positioned within the body support assembly. This is possible because applicant found the optimal volume and temperature required to pass the top surface which did not require larger high capacity air displacement means and heat exchangers. An advantage of having all components within the cuboid body support assembly is that the body support assembly can be stored, stacked and transported easier. Further advantages will be described when describing the invention in more detail below.

In this description and claims terms like above, below, upper, lower and horizontal, vertical will be used to describe the body support assembly in its position in which it is most likely used. It should be understood that these terms are used for purposes of illustration, and are not intended to limit the invention. A term like inwards or inwardly is used to describe a horizontal direction towards the core of the body support assembly.

This heated air flow may also be used to exterminate dust mite which may be present in the cushion volume. By increasing the temperature of the circulating air to above 50° C. and preferably above 60° C., for a certain time while the body support assembly is not used to support a human body, all of the dust mites which are exposed to this higher temperature will be exterminated.

The cushion volume comprises the upper cushion zone nearest to the top surface and the lower cushion zone and separated by the separation sheet. The upper cushion zone and the lower cushion zone comprise of a compressible material which is permeable for air in all directions. Preferably more than 70 vol. %, more preferably more than 80 vol % and even more preferably more than 90 vol. % of the upper cushion zone consists of the compressible material which is permeable for air.

Such an upper and lower cushion zone allow conditioned air to freely flow from a point within the lower cushion zone to the openings in the separation sheet into the upper cushion zone. The air permeability of the material is suitably in the range of from 2 $m^3/s/cm^2$ to 20 $m^3/s/cm^2$, as determined according to the Standard Test Method for Air Permeability of Textile Fabrics, ATSM D737-96.

Preferably, the air permeability of the material is higher than 2, more preferably higher than 10 $cm^3/s/cm^2$, yet more preferably greater than 100 $cm^3/s/cm^2$ as measured by the Standard Test Method for Air Permeability of Textile Fabrics, ATSM D737-96.

The air permeability of the material is suitably higher than 100 $cm^3/s/cm^2$ and preferably higher than 200 $cm^3/s/cm^2$ as measured by the Standard Test Method for Air Permeability of Textile Fabrics, ATSM D737-96.

Suitable materials are non-encased mattress coils, non-woven fabrics and knitted materials. In this invention non-encased mattress coils, such as steel spiral springs, the so called Bonnell-springs or equivalents, may also be used as the compressible material which is permeable for air in all directions. Non-encased mattress coils are preferably used in the lower cushion zone while non-woven fabrics and knitted materials are preferably used in the upper cushion zone.

Alternatively, encased mattress coils may be employed, wherein the air flow may be between and around individual pockets in the case that the encasing material has only a limited air permeability, or by using particularly air permeable encasing materials, such e.g. fabric meshes, e.g. prepare from polyester fabrics.

An example of a suitable knitted material is the so-called warp knitted spacer fabric as described in WO2015/140259 and 2018187348. Such warp knitted spacer fabrics have a first planar warp-knit layer and a second planar warp-knit layer joined by spacer yarns. Preferred warp knitted fabrics are made of polyester. Alternatively, other materials with suitable air permeability may be employed e.g. wadding such as stitched or unstitched non-wovens, or differently knitted or woven materials.

A more preferred material for the lower and especially the upper cushion zone is a so-called random loop bonded structure of a thermoplastic resin. Such materials are for example Breathair® as obtainable from Toyobo Co. and described in for example EP2848721 and EP3064627. Such materials have excellent air permeability properties which exceeds 200 $cm^3/s/cm^2$. The random loop bonded structures are advantageous because their weight per volume is low. One suitably applies this material as sheets of random loop bonded structures having an upper and lower planar sheet. These surfaces are almost as permeable for air as the air permeability of the bulk of the material. This in contrast to the earlier mentioned warp knitted fabrics.

Random loop bonded structures are made in a continuous process wherein a continuous linear structure of a polymer in a near molten state are poured into a shallow layer of for example water. The polymer will form random loops and mutually contact and connect ate these contact points to form bonded points. At the bottom and at the surface a planar random bonded structure results and between these planar surfaces a three dimensional randomly bonded structure results. This production technique limits the thickness of the sheets of random loop bonded material. The distance between these planar surfaces may for example be between 1 cm and 10 cm. Depending on the desired thickness, the distance between top surface and bottom surface of the body assembly and the thickness of the separate cushion zones one or more layers of such random loop bonded structures may be used. In order to obtain optimal cushion properties, it may be preferred to combine different layers with different compression hardness of these materials.

The number of bonded points per unit weight of the three-dimensional random loop bonded structure is between 550 and 1150 bonded points per gram, preferably between 600-1100, more preferably between 650-1050 and even more preferably between 700-1000/g. The number of bonded points per unit weight (unit: the number of bonded points/gram) is a value obtained by a measuring method described in EP2848721. In this method a piece in the form of a rectangular parallelepiped is prepared by cutting a network structure into the shape of a rectangular parallelepiped measuring 5 cm in length×5 cm in width so that the rectangular parallelepiped includes two surface layers of the sample but does not include the peripheral portion of the sample, dividing the number of bonded points per unit volume (unit: the number of bonded points/$cm^3$) in the piece by the apparent density (unit: $g/cm^3$) of the piece. The number of bonded points is measured by a method of detaching a welded part by pulling two linear structures; and measuring the number of detachments.

A random loop bonded structure has an average apparent density within a range of preferably 0.005 $g/cm^3$ to 0.200 $g/cm^3$. The random loop bonded structure having an average apparent density within the above range is expected to show the function of a cushioning material. The average apparent density of less than 0.005 $g/cm^3$ fails to provide repulsive force, and thus the random loop bonded structure is unsuitable for a cushioning material. The average apparent density exceeding 0.200 $g/cm^3$ gives great repulsive force and reduces comfortableness. This is not preferable. The apparent density in the present invention is more preferably 0.010 $g/cm^3$ to 0.150 $g/cm^3$, even more preferably within a range of 0.020 $g/cm^3$ to 0.100 $g/cm^3$.

The 25%-compression hardness of the three-dimensional random loop bonded structure is between 10 and 30 kg/ϕ1200-mm. The 25%-compression hardness is a stress at 25%-compression on a stress-strain curve obtained by compressing the network structure to 75% with a circular compression board measuring 200 mm in diameter.

The thermoplastic resin may be a soft polyolefin or a polyester thermoplastic elastomer. A preferred resin is the so-called P-type PELPRENE® obtainable from Toyobo Co. which is a copolymer composed of an aromatic polyester as a hard element and an aliphatic polyether as a soft element. The term "resin" herein refers to a polymeric material, e.g. polyester, polyamides, polyolefins, elastomers or the like, which—in the present use—have a glass transition temperature and/or melting point well above the operation temperature of the subject body support.

As explained above the compression hardness of the material used may be different in for example the upper and lower cushion zone. For example, the lower cushion zone may comprise of a material having a somewhat hard linear structure while an upper cushion zone may comprise of material having a linear structure with a somewhat thin fineness and a high density. The lower cushion zone material may be a layer that serves to absorb vibration and retain the shape.

A preferred material which is permeable for air in all directions for the lower cushion zone are metal springs, for example Bonnell springs. A Bonnell spring has an hour glass shape (wider at the bottom and the top than the middle) and are interconnected with a mesh of metal to make the spring system.

Alternatively, also continuous coils, i.e. springs having an innerspring configuration in which the rows of coils are formed from a single piece of wire; offset coils of hourglass type coil on which portions of the top and bottom convolutions have been flattened, and usually hinged together with helical wires; Left Facing Knot (LFK) coils, i.e. offset coils with a cylindrical or columnar shape; and/or Marshall coils, also known as wrapped or encased coils or pocket springs may be employed. The latter are usually thin-gauge, barrel-shaped, knotless coils individually encased in fabric pockets.

The non-encased Bonnell metal springs are preferred because they on the one hand provide the required vibration absorption and ability to retain its shape and on the other hand allow air to easily flow through the metal springs without any noticeable pressure drop. The non-encased metal springs are not individually packed in a textile wrapping as for example pocket springs. As set out above, alternatively, encased mattress coils may be employed, wherein the air flow may be between and around individual pockets in the case that the encasing material has only a limited air permeability, or by using particularly air permeable encasing materials, such e.g. fabric meshes, e.g. prepare from polyester fabrics. Preferably, thus, a mesh-encased mattress coil may be employed. The upper cushion zone material may be a layer that can uniformly transmit vibration and repulsive stress to the lower cushion zone so that the whole body undergoes deformation to be able to convert energy, whereby comfortableness can be improved and the durability of the cushion can also be improved. It may also be preferred to impart a thickness and tension to the side portion of the cushion material, wherein the fineness may be somewhat reduced partially and the density may be increased near the side wall. In this way, each layer may have any preferable density and fineness depending on its purpose. It should be noted that the thickness of each layer of the network structure is not particularly limited.

In a preferred embodiment the upper cushion volume comprises the non-woven fabrics and/or knitted materials, such as the three-dimensional random loop bonded structure of a thermoplastic resin and wherein the compressible material in the lower cushion zone are metal springs as described above. Applicants found that the pressure drop the air encounters in the lower cushion zone is very low and a good distribution of the air will result when the air flows to the upper cushion zone. The air permeability of the separation sheet may be lower than the air permeability of the top surface, resulting in a pressure drop across the separation sheet. This pressure drop results in that the air is evenly distributed along the surface of the separation sheet. The separation sheet may be any sheet which covers the metal springs within the lower cushion zone and suitably redistributes the forces of the individual springs along its surface. Such a separation sheet may be woven or non-woven sheets, like for example natural fibre sheets, such as cellulose- or lignocellulose-derived fibres such as coconut fibre sheets, sisal, hemp, flax, and/or cotton fibre sheets, or the like. A preferred separation sheet is made of coconut fibres. This material is advantageous because of its durability and strength. The thickness of the layer of woven or non-woven separation sheet is suitably between 1 and 2 cm.

Another preferred separation sheet is a sheet of a warp knitted spacer fabric as described above. Preferably a polyester warp knitted spaces fabric. Such a layer may be between 1 and 2 cm thick and suitably has a compression hardness which is higher than the compression hardness of the compressible material positioned above this layer in the upper cushion zone. The warp knitted fabric preferably has enough structural strength to cover the metal springs as present in the lower cushion volume and redistribute the forces of the individual springs along its surface.

The body support assembly has a top surface, side walls and a bottom surface. The top surface will face the human body which is being supported by the body support assembly. This top surface is permeable for air. It has been found important that the air permeability of the top surface is higher than the air permeability of the bottom surface. The air permeability of the top surface is also higher than the average air permeability of the side walls. In some embodiments the air permeability of the side walls at the elevation of the upper cushion zone is about the same as the air permeability of the top surface. Because the air permeability of the side walls at the elevation of the lower cushion zone is lower than the top surface the average air permeability of the side walls will be lower. Preferably the air permeability, as measured using ASTM D 737-96, of the top surface is at least 3 times and more preferably 4 times more air permeable than the bottom surface.

The top surface and the side walls, at least at the elevation of the upper cushion zone, is suitably comprised of an air permeable textile cover layer to achieve the desired air permeabilities as described. An example of a material for such a textile cover layer suited for such a top surface is a 3D knitted ventilating textile as for example obtainable from Bekaert Deslee, Belgium or Innofa, The Netherlands and Müller Textil, Wiehl, Germany, which refers to this product as 3Mesh Smart Spacer Fabric. The textile cover layer made of 3D knitted ventilating textile may have a thickness of suitably between 0.3 and 1.5 cm.

The side walls, especially at the elevation of the lower cushion zone, is preferably made of a flexible material which allows that the cushion volume to be compressed to a certain extend when the assembly is used to support a human body. The material is also air tight such that the air flows substantially from the lower cushion zone to the upper cushion zone and not via these side walls. Materials suited for such an air tight layer are tightly woven or knitted textiles. The terms "airtight", "air-tight" and "air tight" as used exchangeable throughout the present specification. The term "air tight fabric" herein refers to a fabric that essentially impervious to gasses at normal pressure, such as e.g. fabrics employed for tents.

The bottom surface may be composed of the same material as the side walls. Because the bottom surface does not necessarily have to be as flexible as the side walls, more stiff materials may be used for the bottom surface. This is advantageous because the bottom surface requires to have enough strength to carry the contents of the cushion volume and provide a support for the metal springs in the preferred embodiment. Materials suited for use for the bottom surface are dense non-woven textiles. Examples of dense non-woven textiles are felt and felt equivalents. Wool or more preferably polyester felts are used. Dense woven textiles and felts will be referred to as felt like textiles in this description. The thickness of such a felt like textiles may be between 0.2 and 0.5 cm. To reduce the air permeability of the felt or felt like textiles it may be preferred to add a dense woven textile layer to the interior side of the felt or felt like textiles.

Preferably the side walls, at the elevation of the lower cushion zone, and the bottom surface are made of tightly woven or knitted textiles. The bottom surface may be composed of the same material as the side walls. Examples of suitable tightly woven or knitted textiles materials are fabrics known for use in tents or as sails. Exemplary materials are woven sheets made of yarns comprised of fibres of nylon, polyester, aramid and polyethylene, optionally in combination with a resin. Preferably sheets used, made of those materials, have flame retardant properties.

Preferably the bottom surface is composed of an inner layer of felt, as described above, an outer layer of the tightly woven or knitted textiles. The layer of felt will provide a suitable support for metal springs as described above and a suitable support for the heat exchanger while the layer of tightly woven or knitted textiles provide an air tight barrier.

Preferably the bottom surface and the part of the side walls at the elevation of the lower cushion zone is comprised of a layer of tightly woven or knitted textiles and wherein the top surface and the part of the side walls is comprised of a textile cover layer, preferably a 3D knitted ventilating textile layer, and wherein the air permeability of the textile cover layer is higher than the air permeability of the tightly woven or knitted textiles as described above. The textile cover layer may further cover the air tight covered side walls at the elevation of the lower cushion zone and the bottom surface as described earlier.

Preferably the air tight layer is comprised of a single sheet of material. Using a single sheet of material is advantageous when manufacturing the body support assemblies. Even more preferably the upper end of the single sheet of the air tight layer is folded inwards and attached to the upper end of the separation sheet. In this folding of a sheet only a part of the sheet covers the separation sheet thereby leaving enough area for air to flow to the upper cushion zone. Preferably more than 80% of the upper area of the separation sheet is not covered. Especially when the lower cushion zone comprises of metal springs a lower part of the bed is thus obtained comprising elements of the body support assembly having a long lifetime. Further the lower part will comprise the more complex and durable elements like the air displacement means and the heat exchanger. In contrast the lifetime of the non-woven fabrics and knitted materials, such as the three-dimensional random loop bonded structure of a thermoplastic resin, which are preferably used in the upper cushion zone is shorter. This because in time the ability of such cushion materials to return to their original shape becomes less. The above felt encased lower part of the body support assembly can now be advantageously be reused and combined with a upper part of the body support assembly comprising new compressible material.

Preferably the lower end of the textile cover layer extends to the bottom surface of the body support assembly and is folded inwards thereby covering the side walls made of a layer of felt or felt like textile and part or all of the bottom surface made of felt or felt like textile. In this manner the majority of the outer surface and especially the visible part of the body support assembly when in use will be covered by this textile layer. This textile cover layer thus holds the body support assembly zone together. This textile cover layer may form the outer layer of the entire bed assembly including any added layers as described below. For easy assembly such a textile cover layer is suitably made of at least two parts which can be connected by sowing and preferably detachably connected for example by means of for example a zipper, loop and hook bonds (or Velcro connection) or buttons. The two parts may be one part comprising the top surface, the side walls at the elevation of the upper cushion zone and covering part of the side walls at the elevation of the lower cushion zone and a second part covering the bottom surface or any optional added layer to said bottom surface and the remaining part of the side walls at the elevation of the lower cushion zone.

Applicants found that the above described concept of providing a lower part of a body support assembly including more durable elements like the metal springs and an upper part having a less durable but preferred compressible material can also be used without the air flow elements, like the air displacement means and heat exchangers, of the present invention. The invention is thus also directed to the following body support assembly.

Body support assembly having a top surface for supporting a human body and a spaced away bottom surface defining a cushion volume and defining side walls, wherein the cushion volume comprises an upper cushion zone nearest to the top surface comprising of a compressible material and a lower cushion zone comprising of metal springs, suitably Bonnell spring, as present between the bottom surface and a separation sheet, wherein the bottom surface and the part of the side walls at the elevation of the lower cushion zone is comprised of a single sheet of an air tight layer and wherein the top surface and the side walls is comprised of a textile cover layer, wherein the upper end of the air tight layer is folded inwards and attached to the upper end of the separation sheet and wherein the lower end of the textile cover layer extends to the bottom surface and is folded inwards thereby covering the side walls comprised of the air tight layer and covering part or all of the bottom surface comprised the air tight layer.

Preferred materials, shapes and combinations for this body support assembly are the same as described for the body support assembly provided with the heat exchanger according to this invention. Especially the compressible material is a three-dimensional random loop bonded structure of a thermoplastic resin or polymers. The separation sheet is suitably made of coconut fibres or a warp knitted spacer fabric.

The body support assembly is preferably used as a mattress. The invention is therefore also directed to a bed comprising a body support assembly according to this invention. The bed will have some sort of structure to support the mattress. This mattress support should leave an opening or openings at its lower end to allow air to flow into the air inlet opening or openings at the bottom surface of the support assembly. Examples of suited mattress supports are a spiral wire support, a slatted bed base or a wooden board.

The size of the body support assembly may be as the size of a single person matrass. When king size or queen size matrasses are required it may be preferred to combine two body support assemblies having the size of a single person matrass. The only difference is that the textile cover layer of the two separate body support assemblies is combined in one textile cover layer. In this manner the king size or queen size matrass has the outer appearance of a single product. Since the matrass will have two heat exchangers and separate lower and upper cushion zones, it is possible to set different temperatures for the resulting neighbouring two body support zones.

When the matrass support does not allow air to flow to the air inlet, like for example a box spring it may be advantageous to add a layer of a material which is permeable for air to the bottom-end of the body support assembly. This layer will sit between the body support assembly and the matrass support. Suitably this layer extends upwards at the side walls at the elevation of the lower cushion zone. Air may flow from the sides of this layer facing the environment of the body support assembly and to the air inlet. An example of a suitable material which is permeable for air may be a layer of metal mini springs or a sheet of a warp knitted spacer fabric. This material is permeable for air in all directions. Alternatively, two or more different materials may be employed, to avoid e.g. compression wrinkles at the corners or other positions where the sheets are bent. An example of such materials includes a combination of a warp knitted spacer fabric and a non-woven padding.

The layer of material which is permeable for air may also support the preferred metal springs as present in the lower cushion zone. Because of this support alternatives for the above described felt like layer may be used, like for example tightly knitted or woven fabrics.

The body support assembly provided with such an added layer to the bottom surface is especially an assembly wherein the upper cushion volume comprises the above described compressible material which is permeable for air in all directions has an air permeability of greater than 100 $cm^3/s/cm^2$ as measured by ASTM D737 and especially the above described three-dimensional random loop bonded structure of a thermoplastic resin. The compressible material in the lower cushion volume are metal springs. The bottom surface and the part of the side walls at the elevation of the lower cushion zone is comprised of an air tight cover layer and wherein the top surface and the part or all of the side walls is comprised of a textile cover layer and wherein the air permeability of the textile cover layer is higher than the air permeability of the air tight cover layer.

The above described air tight cover layer is suitably comprised of a single sheet and the textile cover layer may be a single sheet of textile or consist of for example two parts as described above. The textile cover layer may be a 3D knitted ventilating textile layer as described for the earlier described embodiment of the body support assembly. The upper end of the air tight cover layer is folded inwards and attached to the upper end of the separation sheet leaving most of the upper end of the separation sheet not covered by said air tight cover layer. Preferably more than 80% of the upper area of the separation sheet is not covered by the air tight cover layer.

Preferably the textile cover layer covers the top surface, the side walls of the body support assembly and the lower end of the layer of the material which is permeable for air. In this way the textile cover layer will envelope the combined body support assembly and the added layer connected to its bottom. When such a combined assembly is positioned on top of for example a box spring mattress support air will pass the textile cover layer and flow via the layer of the material which is permeable for air to the air inlet.

When a material is used for the air tight cover layer which does not have the structural strength of for example felt it may be advantageous to add a surface of felt to position the heat exchanger in the body support assembly as will be described below.

Suitably the body support assembly has an end for placement of the head of the human body and an end for placement of the feet of the human body. The air displacement means and the heat exchanger are then suitably positioned at the end for the feet. This to minimise the hinder of any noise generated by the air displacement means. This further enables one to have more cushion material, like Bonnell springs, below the possible position of the head in the lower cushion zone.

The heat exchanger may be any device which is capable of increasing the temperature of a gas, like air. The heat exchanger may be a Peltier element or may explicitly not be a Peltier element. Suitably the heat exchanger comprises electric-resistance heating coils. Air flowing along the surface of the resistance heating will increase in temperature. More preferably the heat exchanger is a Positive Temperature Coefficient (PTC) Air Heater. Such PTC air heaters are advantageous because the temperature will not exceed a certain value which provides a user safe solution.

The air displacement means may be any means capable of moving air from the exterior of the body support assembly via the heat exchanger, the lower cushion zone, the separation sheet and upper cushion zone and top surface. A suitable air displacement means is a fan that provides for a sufficiently high air flow, without unsuitable generation of noise. A particularly suitable fan may be a tangential fan, also referred to as a cross-flow fan.

The air inlet in the bottom surface of the body support surface comprises an opening in the bottom surface. This opening is suitably provided with a detachable air filter. Such an air filter may be non-woven or paper sheet suited to avoid dust and the like to enter the body support assembly. Such a filter will be required to be replaced by a new filter after using the body support assembly for some time. Preferably air filter is held into place by a planar spring, which planar spring can be manually removed when detaching the air filter. The new filter can be secured by replacing the planar spring.

When the air inlet in the bottom surface comprises an opening in a felt or felt like textile bottom surface it may be preferred to connect a frame to the lower end of the felt bottom surface and connected to a matching frame positioned above the felt bottom surface. In this manner a strip of felt layer at the opening is sandwiched by the two frame parts. The connected frames provide for an opening for the air inlet. The matching frame may be the support for the heat exchanger-fan combination. This enables a simple configuration for positioning the heat exchanger and fan within the lower cushion zone.

The power supply for the heat exchanger and air displacement means may be provided by means of a cable directly connected to the mattress or via the mattress support. A small power adaptor may be externally present. If the power supply is performed via the mattress support simple power exchange surfaces may be present at the exterior of the mattress which connect with power supply surfaces present on the mattress support. This may be preferred when one wishes a mattress without any cables extending from the mattress.

The invention is also directed to a method to heat a body support assembly having a top surface for supporting a human body and a spaced away bottom surface defining a cushion volume and defining side walls, wherein the cushion volume comprises, an upper cushion zone nearest to the top surface and a lower cushion zone and separated by a separation sheet, wherein the upper cushion zone and the lower cushion zone comprise of a compressible material which is permeable for air in all directions, and wherein ambient air flows in a flow path via an air inlet, air displacement means, a heat exchanger, a flow path through the compressible material of the lower cushion zone, through openings in the separation sheet, through the compressible material of the upper cushion zone and through the top surface.

Preferably the temperature of the air as it flows through compressible material of the upper cushion zone has a temperature of between 15° C. and 40° C., preferably of between 18° C. and 38° C., yet more preferably between 27° C. and 35° C. The optimal temperature will depend on the body temperature of the person being supported by the body support assembly, preferably 2° C. to 4° C., more preferably 3° C. below the body temperature. This temperature may vary per person and suitably this temperature may be varied by the user such to obtain the optimal conditions by means of trail and error. The desired temperature may be the input of a measurement and control algorithm of the body support assembly using an input console. This console may be directly contacted or indirectly contacted with the measurement and control algorithm, for example using an app on a smartphone. Once a desired temperature is chosen a measurement and control algorithm is used to reach this temperature. Preferably the temperature of the air in the upper cushion zone is controlled by measurement of the temperature of the air in the upper cushion zone and in case of a required adjustment changing the performance of the heat exchanger and/or the performance of the air displacement means. Preferably the method uses a body support assembly according to this invention.

The invention will be illustrated making use of the following FIGS. 1-10.

FIG. 1 shows a body support assembly (1) according to the invention in a 3D presentation as seen from above. The assembly (1) has a top surface (2) for supporting a human body and a spaced away bottom surface (3) defining a cushion volume (4) and defining side walls (5). The air permeable top surface (2) has multiple air outlets (2*a*). The air permeability of the top surface (2) is higher than the air permeability of the bottom surface (3) and higher than the average air permeability of the side walls (5).

Figure 2:
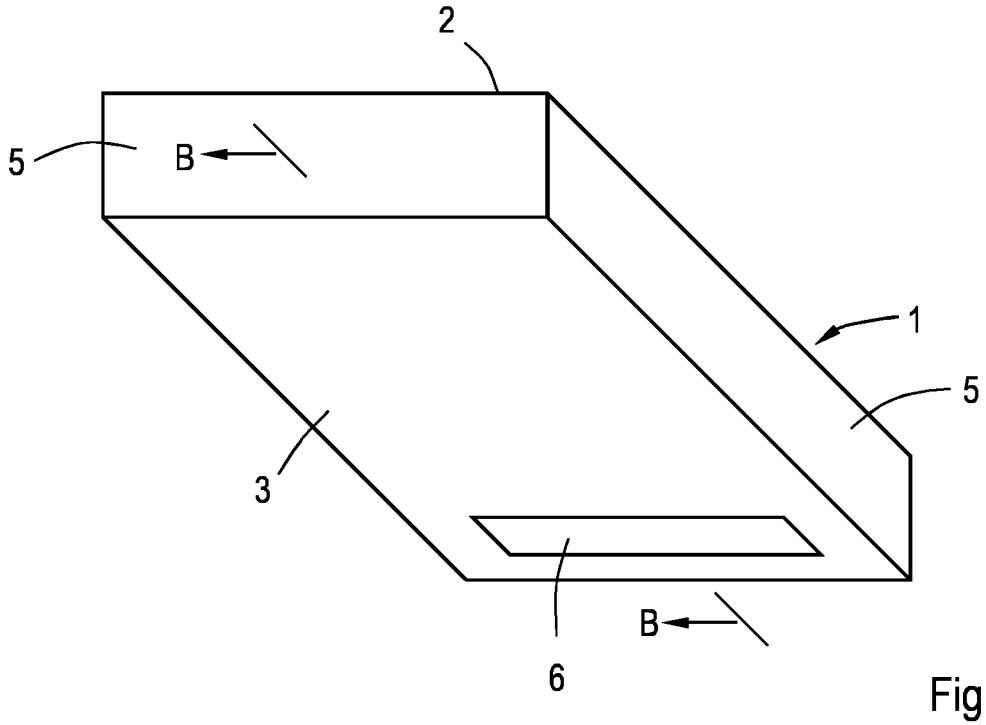

FIG. 2 shows the body support assembly (1) of FIG. 1 as seen from below showing an air inlet (6).

Figure 3:
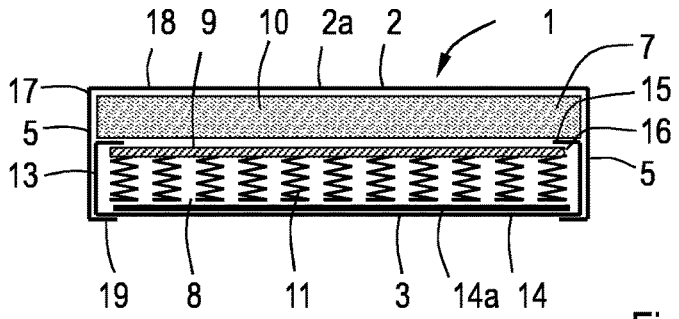

FIG. 3 shows the cross-sectional view AA' of FIG. 1 of the body support assembly (1). In this Figure an upper cushion zone (7) nearest to the top surface (2) and a lower cushion zone (8) and separated by a separation sheet (9) made of coconut fibres is shown. The sheet of coconut fibres is provided with multiple openings (9*a*) to allow air to pass from the lower cushion zone (8) to the upper cushion zone (7). The upper cushion zone (7) comprises of Breathair® as the compressible material (10). The lower cushion zone is comprised of Bonnell springs (11). In this figure the bottom surface (3) and the part (13) of the side walls (5) at the elevation of the lower cushion zone (8) is comprised of a single sheet (14) of a tightly woven polyester tent sheet. The upper end (15) of the tent sheet is folded inwards and attached to the upper end (16) of the coconut separation sheet (8). Attachment may by for example by means of an adhesive. The folding of the single sheet may be performed using well known Origami folding techniques. As shown a large part of the coconut separation sheet (8) is not fully covered by the tent sheet (14) leaving enough area through which air can flow from the lower cushion zone (8) to the upper cushion zone (7). A layer of felt (14*a*) is present as part of the bottom end (3) to provide support for the Bonnell springs (11) and provide a support to fix the heat exchanger (21) as shown in FIGS. 4, 5 and 6.

FIG. 3 also shows the top surface (2) and the part (17) of the side walls (5) is comprised of a single sheet of a textile layer (18), for example a 3D knitted ventilating textile. The lower end (19) of the textile layer (18) extends to the bottom surface (3) and is folded inwards thereby covering the entire side walls (5) and the tent sheet covered part (13) of the side walls (5) at the elevation of the lower cushion zone (8). The lower end (19) is attached to the tent sheet (14) by for example by a hook and loop type connection, such as for example a Velcro type connection. The folding of the single sheet may be performed using well known Origami folding techniques. The textile layer (18) thereby holds together the upper (7) and lower (8) cushion zone. By removing the textile layer (18) it is possible to simply remove the compressible material (10) of the upper cushion zone after which new compressible material (10) may be provided. In this manner the tent sheet encapsulated lower cushion zone (8) can be reused in combination with a new upper cushion zone. The single sheet of a textile layer is thus detachably wrapped around the cushion volume. When detached from the cushion zone the sheet of textile layer is suitably a flat sheet which is not sewed into a three-dimensional shape. This enables easier cleaning of the sheet and a simpler manufacture of the textile sheet itself.

Figure 4:
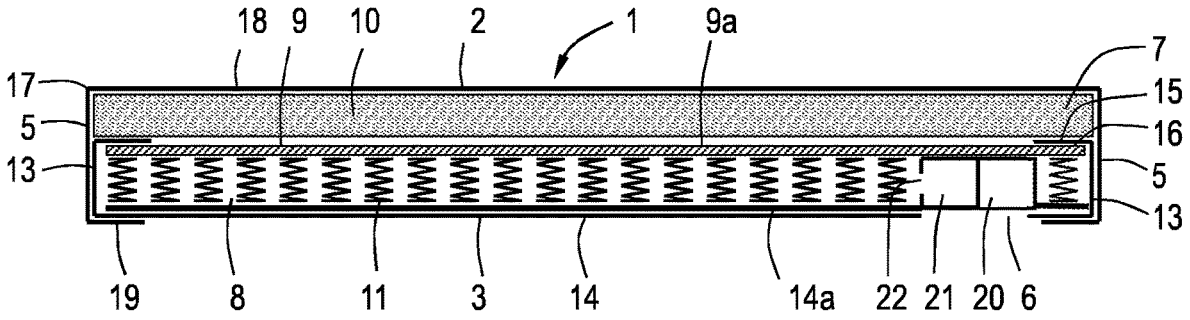

FIG. 4 shows the cross-sectional view BB' of FIG. 2 of the body support assembly (1). In addition to the elements shown in FIG. 3 an air inlet (6), a fan (20) and a heat exchanger (21) is schematically shown. Further a heated air outlet (22) in fluid communication with the lower cushion zone (8) is present through which heated air flows from the heat exchanger (21) to the lower cushion zone (8). The dimensions and properties of the coconut fibre separation sheet are so chosen that air flowing to the upper cushion zone is evenly distributed. A suitable coconut fibre separation sheet may have a thickness of between 1 and 2 cm. The height of the lower cushion zone (8) may be between 8 and 15 cm. The height of the upper cushion zone (7) may be between 4 and 8 cm. The distance between top surface (2) bottom surface (3) may be between 14 and 25 cm.

Figure 5:
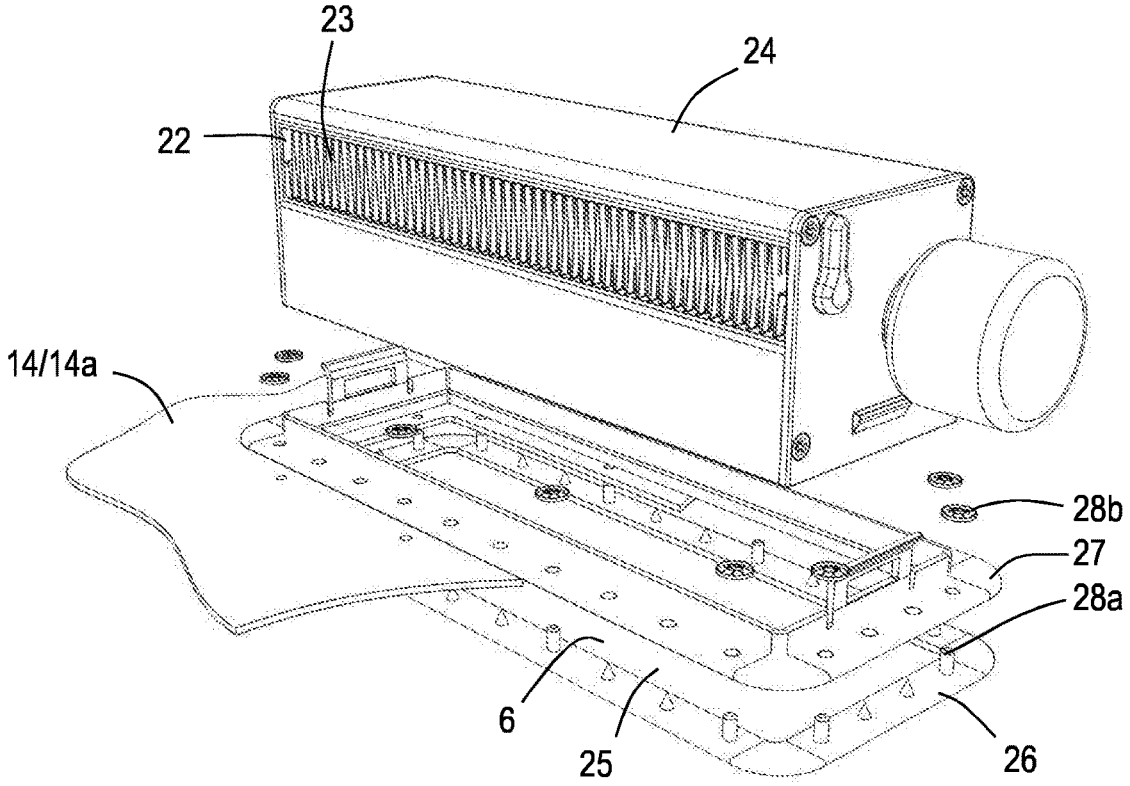
Figure 6:
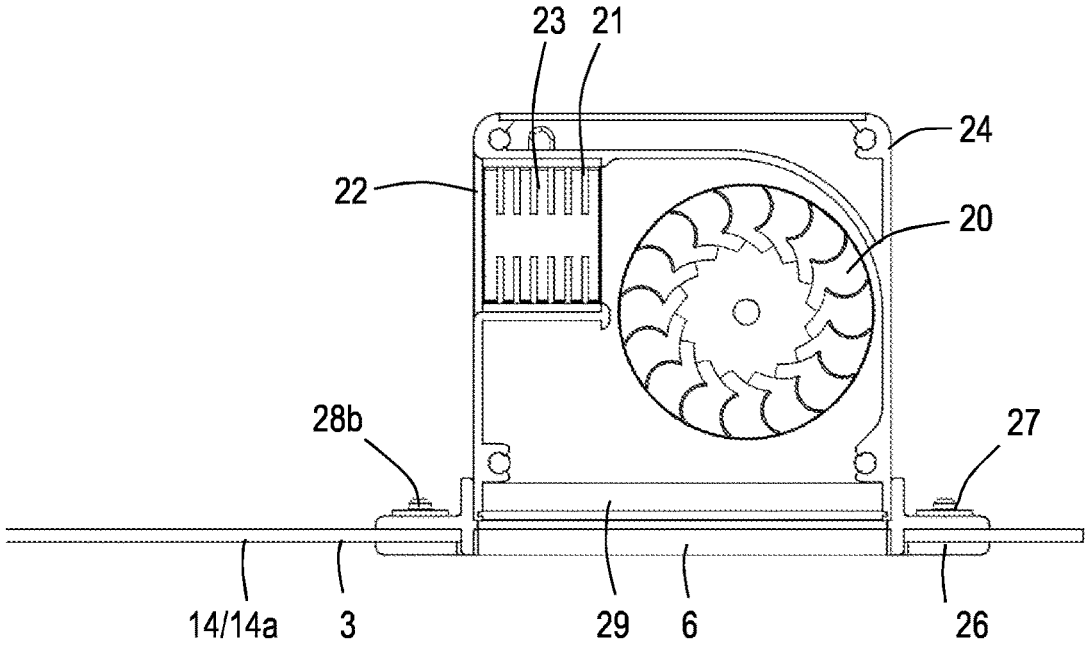

FIGS. 5 and 6 show the fan (20)-heat exchanger (21) combination in more detail. The various elements are shown in an exploded view in FIG. 5. In FIG. 6 a cross section of the fan (20)-heat exchanger combination (21) is shown. The heat exchanger and fan are placed in a box like casing (24). Heat exchanger (21) is provided with electric-resistance heating coils (23) as placed in heated air outlet (22). The air inlet (6) in the bottom surface (3) comprises an opening (25) in interior layer of felt (14*a*) and in the exterior layer of the air tight cover layer (14). To this opening (25) a frame (26) is connected to the lower end of the felt bottom surface (3) and a matching frame (27) is positioned above the felt bottom surface. The two frames (26, 27) are connected by means of multiple connectors (28), for example plug (28*a*) and lock rings (28*b*), thereby sandwiching a strip of felt layer at the opening (6). The two frames (26, 27) as present in opening (25) form air inlet (6). In this opening (6) an air filter (29) is positioned as shown in FIG. 6. The matching frame (27) serves as support for the box like casing (24). The fan (20) is a tangential fan.

Figure 7:
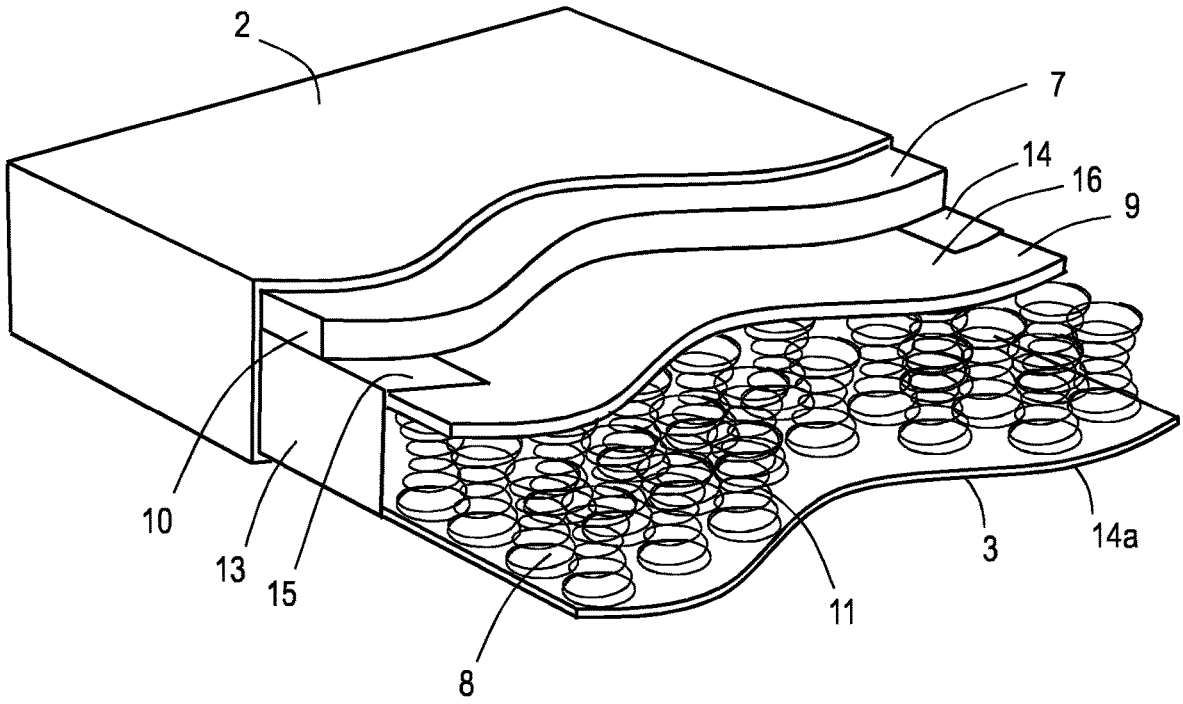

FIG. 7 shows a cut open body support assembly of FIGS. 3 and 4.

Figure 8:
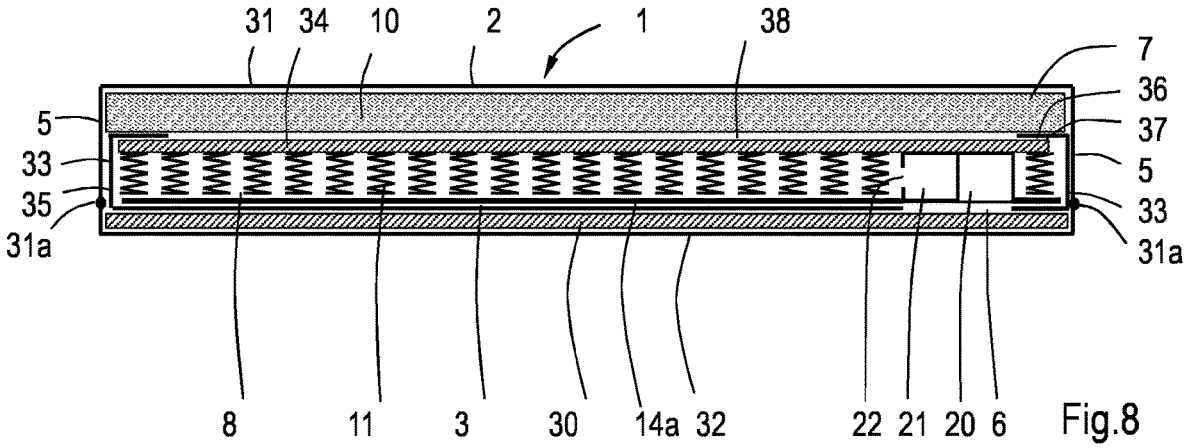

FIG. 8 shows the cross-sectional view of a body support assembly similar to FIG. 4. The common reference numbers have the same meaning as in FIG. 4. In FIG. 8 a layer (30) of a polyester warp knitted spacer fabric is present at the lower end (3) of the body support assembly (1). This layer is connected or held in place by a textile cover (31), made of a 0.5 cm thick layer of a polyester 3Mesh Smart Spacer Fabric which is permeable for air.

The layer (31) may be prepared from a single material, or may comprises two or more different materials with slightly different air permeability, e.g. polyester wadding combined with a 3Mesh spacer fabric. This combination allows for an easier bending and fit at corners and bends.

This textile cover layer (31) covers the upper end of the top surface (2), the side walls (5) of the body support assembly and the lower end (32) of the layer (30) warp knitted spacer fabric. The textile cover layer (31) is made of two detachable parts which are connected by a zipper (31*a*). A layer of felt (14*a*) is present as part of the bottom end (3) to provide support for the Bonnell springs (11) and provide a support to fix the heat exchanger (21) as shown in FIGS. 4, 5 and 6.

The separation sheet is a layer (34) of polyester warp knitted spaces fabric. This layer (34) redistributes air and further prevents the Breathair® material to be partially compressed into the openings of the Bonnell springs (11). The bottom surface (3) and the part (35) of the side walls (5) at the elevation of the lower cushion zone (8) is comprised of an air tight cover layer (33) made of a tightly woven polyester tent sheet having a thickness of about 1.5 mm. The upper end (36) of layer (34) is folded inwards and attached to the upper end (37) of layer (34) leaving an opening (38) for air to flow from the lower cushion zone (8) to the upper cushion zone (7). Upper end (36) may be connected to the upper end (37) by any means, such as sewing. Preferably such connection is detachable by for example using hooks or strips of hook and loop fasteners. For illustration purposes the height of the upper cushion zone may be 5 cm, the thickness of the separation sheet (34) may be 2 cm, the height of the lower cushion zone may be 15 cm and the thickness of layer (30) may be 2.5 to 3 cm.

The composition, e.g. the Breathair® compressible material (10), the layer (34), layer (30), sheet (31) and sheet (33) of the illustrated body support assembly in FIG. 8 may be chosen to be mainly composed of, and made of polyester, thereby resulting in a body support assembly that is more easily recyclable.

Figure 9:
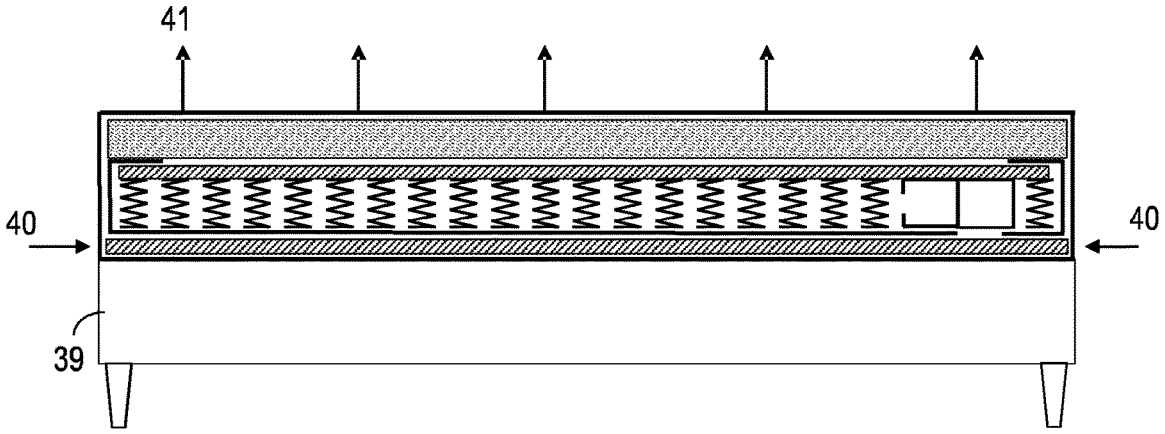
Figure 10:
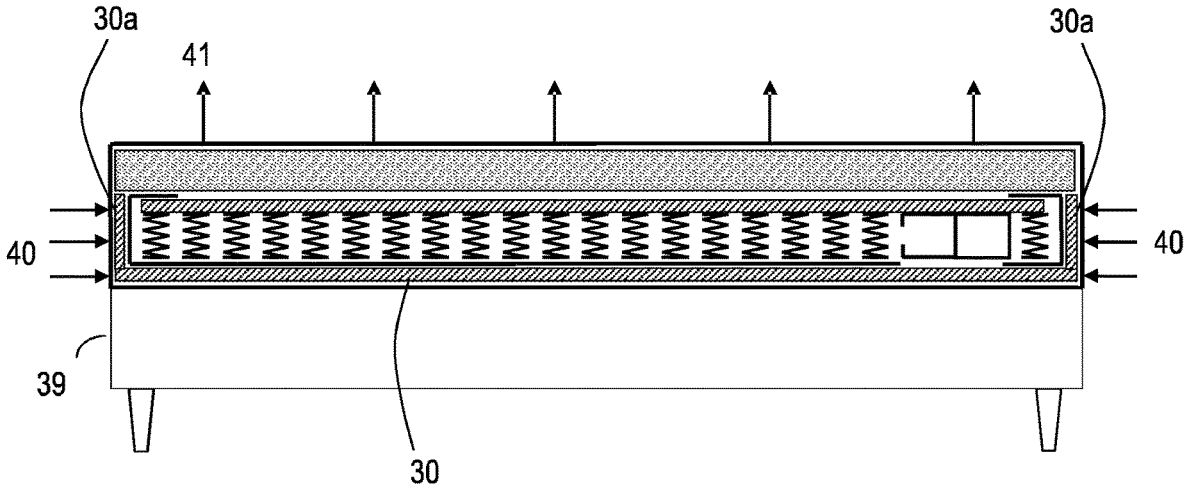

When an assembly of FIG. 8 is positioned on a box spring matrass support (39), or a similarly air impervious support as shown in FIG. 9 air will enter layer (30) as indicated by arrows (40) and leave the assembly (1) as indicated by arrows (41). Layer 30 preferably has a thickness in the range of from 10 to 40 mm, preferably of from 20 to 30 mm. This thickness, combined with the high air permeability, was found to permit to provide the fan with sufficient air inflow. FIG. 10 shows a body support assembly on a box spring support (39) as in FIG. 9 except that layer (30) extends upwards as upward layer part (30*a*) at the elevation of the lower cushion zone (8). Upward layer part (30*a*) hereby covers all 4 side wall parts thereby covering part of the air tight cover layer (33). The textile cover layer (31) remains the outer layer at the side walls (5). Air can enter the layer (30) also via the upward layer part (30*a*) as indicated by arrows (40) and flow to inlet (6) because layer (30) and upward part layer (30*a*) are fluidly connected, suitably made from a single piece of material. This design is advantageous because air will have more opportunities to flow to air inlet (6). This is especially advantageous when body support assemblies are positioned next to each other or next to a wall.

The invention claimed is:

1. A body support assembly having an air permeable top surface for supporting a human body and a spaced away bottom surface defining a cushion volume and defining side walls, wherein the air permeability of the top surface is higher than the air permeability of the bottom surface and higher than the air permeability of the side walls, wherein the air permeable top surface has multiple air outlets and wherein the cushion volume comprises, an upper cushion zone nearest to the top surface and a lower cushion zone and separated by a separation sheet provided with openings, wherein the upper cushion zone and the lower cushion zone comprise of a compressible material which is permeable for air in all directions and a flow path for air comprising an air inlet in the bottom surface, air displacement means, a heat exchanger, a flow path through the compressible material of the lower cushion zone, through the openings in the separation sheet and through the compressible material of the upper cushion zone and multiple air outlets as present in the top surface, wherein the top surface for supporting a human body and a spaced away bottom surface defining a cushion volume and further define the side walls, wherein the cushion volume comprises an upper cushion zone nearest to the top surface comprising of the compressible material and a lower cushion zone comprising Bonnell springs as present between the bottom surface and a separation sheet, wherein the bottom surface and the part of the side walls at the elevation of the lower cushion zone is comprised of a single sheet of an air tight layer and wherein the top surface and the part of the side walls is comprised of a textile cover layer, wherein the upper end of the air tight layer is folded inwards and attached to the upper end of the separation sheet and wherein the lower end of the textile cover layer extends to the bottom surface and is folded inwards thereby covering the side walls comprised of the air tight layer and covering part or all of the bottom surface comprised of the air tight layer.

2. The body support assembly according to claim 1, wherein the compressible material which is permeable for air in all directions has an air permeability of greater than 10 cm3/s/cm2, as measured by ASTM D737.

3. The body support assembly according to claim 1, wherein the compressible material which is permeable for air in all directions has an air permeability of greater than 10 $cm^3/s/cm^2$ as measured by ASTM D737, and wherein the compressible material is a three-dimensional random loop bonded structure of a thermoplastic resin.

4. The body support assembly according to claim 1, wherein the compressible material which is permeable for air in all directions has an air permeability of greater than 10 $cm^3/s/cm^2$ as measured by ASTM D737, and wherein the upper cushion volume comprises the compressible material, and wherein the compressible material in the lower cushion volume comprises metal springs.

5. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, and wherein the metal springs comprise Bonnell springs or equivalents thereof.

6. The body support assembly according to claim 1, wherein the air permeability of the separation sheet is lower than the air permeability of the top surface, and wherein the separation sheet is a sheet of a spacer fabric.

7. A bed comprising a body support assembly according to claim 1 and a mattress support.

8. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part or all of the side walls is comprised of a textile cover layer, and wherein the air permeability of the textile cover layer is higher than the air permeability of the airtight cover layer.

9. The body support assembly according to claim 8, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part or all of the side walls is comprised of a textile cover layer, and wherein the air permeability of the textile cover layer is higher than the air permeability of the airtight cover layer, and wherein the textile cover layer further fully covers part of the side walls at the elevation of the lower cushion zone and the layer of the material which is permeable for air in all directions, and wherein the air tight cover layer is comprised of a single sheet and the textile cover layer is comprised of at least two detachably connected parts of sheet textile.

10. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part or all of the side walls is comprised of a textile cover layer, and wherein the air permeability of the textile cover layer is higher than the air permeability of the airtight cover layer, and wherein the upper end of the air-tight cover layer is folded inwards and attached to the upper end of the separation sheet leaving most of the upper end of the separation sheet not covered by said air tight cover layer.

11. A method to heat a body support assembly of claim 1 having a top surface for supporting a human body and a spaced away bottom surface defining a cushion volume and defining side walls, wherein the cushion volume comprises, an upper cushion zone nearest to the top surface and a lower cushion zone and separated by a separation sheet, wherein the upper cushion zone and the lower cushion zone comprise of a compressible material which is permeable for air in all directions, and wherein ambient airflows in a flow path via an air inlet, air displacement means, a heat exchanger, a flow path through the compressible material of the lower cushion zone, through openings in the separation sheet, through the compressible material of the upper cushion zone and through the top surface.

12. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part or all of the side walls is comprised of a textile cover layer and wherein the air permeability of the textile cover layer is higher than the air permeability of the airtight cover layer, and wherein between the bottom surface is comprised of an interior layer of felt and an exterior layer of the air tight cover layer.

13. The body support assembly according to claim 1, wherein a layer of a material which is permeable for air in all directions is connected to the bottom surface of the body support assembly and wherein the layer is a sheet of a warp knitted spacer fabric.

14. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part of the side walls is comprised of a textile cover layer and wherein the air permeability of the textile cover layer is higher than the air permeability of the airtight cover layer, wherein between the bottom surface is comprised of an interior layer of felt and an exterior layer of the air tight cover layer, and wherein the air inlet in the bottom surface comprises an opening in the interior layer of felt and in the exterior layer of the air tight cover layer, a frame connected to the lower end of the opening and connected to a matching frame positioned above the opening, thereby sandwiching a strip of the interior layer of felt and the exterior layer of the air tight cover layer at the opening and wherein the connected frames provide for an opening for the air inlet and wherein the matching frame is the support for the heat exchanger.

15. The body support assembly according to claim 1, wherein the compressible material which is permeable for air in all directions has an air permeability of greater than 10 $cm^3/s/cm^2$ as measured by ASTM D737, wherein the upper cushion volume comprises the compressible material, wherein the compressible material in the lower cushion volume comprises metal springs, wherein the compressible material in the upper cushion volume comprises the compressible material and wherein the compressible material in the lower cushion volume comprises metal springs, wherein the bottom surface and the part of the side walls at the elevation of the lower cushion zone is comprised of an airtight cover layer, wherein the top surface and the part or all of the side walls is comprised of a textile cover layer and wherein the air permeability of the textile cover layer is higher than the air permeability of the airtight cover layer and wherein the layer of a material which is permeable for air in all directions extends upwards as upward part as positioned between the air tight cover layer and the textile cover layer.

16. The body support assembly according to claim 1, wherein the air displacement means is a tangential fan.

17. The body support assembly according to claim 1, wherein the heat exchanger is a Positive Temperature Coefficient (PTC) Air Heater.

18. The body support assembly according to claim 1, wherein the compressible material is a three-dimensional random loop bonded structure of a thermoplastic resin.

19. The body support assembly according to claim 18, wherein the separation sheet is made of natural fibres, wherein the separation sheet is a sheet of a warp knitted spacer fabric, and Wherein the textile cover layer covers the entire bottom surface and is comprised of at least two detachably connected parts of a sheet of textile.

* * * * *